United States Patent [19]

Schiff

[14] 3,969,234

[45] July 13, 1976

[54] LUBRICANT AND MOTOR FUEL ADDITIVES

[75] Inventor: Sidney Schiff, Bartlesville, Okla.

[73] Assignee: Phillips Petroleum Company, Bartlesville, Okla.

[22] Filed: Sept. 8, 1975

[21] Appl. No.: 610,967

[52] U.S. Cl. ..... 252/33; 44/72

[51] Int. Cl.[2] ..... C10M 1/40; C10L 1/22; C10M 3/34

[58] Field of Search ..... 44/72; 252/33

[56] References Cited

UNITED STATES PATENTS

| | | | |
|---|---|---|---|
| 3,284,409 | 11/1966 | Dorer | 252/49.9 |
| 3,344,069 | 9/1967 | Stuebe | 252/49.6 |
| 3,385,791 | 5/1968 | Colyer et al. | 252/32.7 |
| 3,449,362 | 6/1969 | Lee | 260/326.3 |
| 3,703,536 | 11/1972 | Piasek et al. | 260/462 R |
| 3,704,308 | 11/1972 | Piasek et al. | 60/462 R |
| 3,766,150 | 10/1973 | Schiff et al. | 260/79.3 R |
| 3,767,574 | 10/1973 | Schiff | 44/72 |
| 3,829,381 | 8/1974 | LeSuer | 252/33.4 |
| 3,846,316 | 11/1974 | Schiff et al. | 252/33 |
| 3,907,691 | 9/1975 | King et al. | 252/33 |

*Primary Examiner*—Delbert E. Gantz
*Assistant Examiner*—I. Vaughn

[57] ABSTRACT

Improved additives for lubricants and motor fuels are provided by borating the reaction product obtained upon reacting a petroleum sulfonic acid with a polyamine. Lubricating oil compositions and motor fuels containing said additives are also provided.

14 Claims, No Drawings

LUBRICANT AND MOTOR FUEL ADDITIVES

This invention relates to improved additives for lubricants and motor fuels. In one aspect, this invention relates to the preparation of novel compositions formed from a petroleum sulfonic acid, a polyamine, and a boron compound. In accordance with another aspect, this invention relates to lubricant compositions containing, as an additive, the borated reaction product formed from a petroleum sulfonic acid and a polyamine. In accordance with another aspect, this invention relates to motor fuel compositions containing as an additive the borated reaction product formed by contacting a petroleum sulfonic acid with a polyamine. In accordance with a further aspect, this invention relates to a process for the preparation of improved ashless additives for lubricants and motor fuels.

At the present time it is common practice to enhance or modify certain of the properties of lubricating oils through the use of various additives or improvement agents. The lubricating oils employed in internal combustion engines, such as automotive, light aircraft, and diesel engines, in particular, require the use of additive agents to render them serviceable under the adverse environmental conditions frequently encountered in the operation of these engines. Among the various additives employed in modern engine oils, one of the most important is the type which acts to prevent accumulation of sludge in the crankcase and on the cylinder walls, thereby preventing sticking of the piston rings, and the formation of varnish-like coating on the pistons and cylinder walls. Because of their general function of maintaining a clean engine, additives of this nature are termed "detergents" although it is now understood that they have little utility in cleaning a dirty engine but by virtue of dispersant activity prevent or greatly retard engine fouling.

As cleanliness requirements have called for greater concentrations of detergent additives, the problem of ash deposition in the combustion chamber has become more serious. Especially is this a problem in certain engines which tend to develop violent preignition troubles in the presence of metal-containing ash. These problems have increased the importance and desirability of using "ashless" detergents.

An ashless detergent is one which shows substantially no ash when tested by ASTM procedure D-482-59T. The only possible source of metal when using such an additive is that of corrosion products and trace quantities present in some crude oils. It can be generally stated that metal-containing deposits in an engine (1) contribute to valve burning, (2) contribute to preignition, (3) tend to foul and short-out spark plugs, and (4) tend to increase octane requirements. Use of conventional metal-containing detergents can contribute to the deposit of metal-containing materials in the combustion chamber. Metal-containing deposits do not form from ashless detergents. Use of an ashless detergent, therefore, materially reduces the problems normally encountered in internal combustion engines in connection with metal-containing deposits.

It has been found that reaction products having improved detergent and dispersant properties can be prepared by reacting a petroleum sulfonic acid with a polyamine and a boron compound. Thus, broadly speaking, the present invention resides in the reaction product or products obtained when a petroleum sulfonic acid is reacted with a polyamine and a boron compound as new additives for lubricants and motor fuels; methods of preparing said new additives; and lubricant and motor fuel compositions containing said new additives.

An object of this invention is to provide an ashless additive for lubricants.

Another object of this invention is to provide improved additives exhibiting reduced deposit-forming tendencies in motor fuels.

Another object of this invention is to provide a method for the preparation of additives for lubricating oils and motor fuels.

Another object of this invention is to provide an improved lubricating composition utilizing the additives of the invention.

Another object of this invention is to provide improved motor fuel compositions utilizing the additives of the invention.

Other aspects, objects, and advantages of the invention will be apparent to those skilled in the art upon studying this disclosure.

Thus, according to the invention, there is provided new compositions comprising the oil soluble borated reaction product or products obtained upon reacting a petroleum sulfonic acid with a polyamine and a boron compound.

Further, according to the invention, there is provided a process for producing an additive for lubricants and motor fuels which process comprises reacting a petroleum sulfonic acid and a polyamine to form an amine petroleum sulfonic acid, and then reacting the amine petroleum sulfonic acid thus formed with a boron compound to form said additive.

Further, according to the invention, there is provided as new additives for lubricants and motor fuels a product additive obtained by the process described in the preceeding paragraph.

Still further, according to the invention, there is provided new lubricating oil compositions comprising a major proportion of a lubricating oil base stock and a minor proportion of a new additive in accordance with the invention.

Still further, according to the invention, there is provided new motor fuel compositions comprising a major proportion of a motor fuel and a minor proportion of a new additive in accordance with the invention.

A wide variety of reaction conditions can be employed in the practice of the invention. Any reaction conditions under which the reactions involved in the invention will take place are within the scope of the invention. Similarly, any proportions of reactants which will react with each other to produce a product additive of the invention are within the scope of the invention. However, as will be understood by those skilled in the art in view of this disclosure, certain reaction conditions and reactant proportions are favored for economic reasons, i.e., the reactions proceed faster and give greater yields for some reaction conditions and some proportions of reactants. The reaction or reactions involved in preparing the product additives of the invention can be carried out in the presence or absence of a diluent which is chemically inert, i.e., does not react with the reactants or reaction products.

Generally speaking, any petroleum sulfonic acid prepared in accordance with methods known in the art can be employed in this invention. For example, U.S. Pat. No. 3,135,693 describes a method of making metal petroleum sulfonates in which a petroleum sulfonic acid is prepared as an intermediate.

A wide variety of oils can be used as the charge oils in preparing the petroleum sulfonic acids of this invention. Preferably, the charge oil is selected from viscous oil fractions of petroleum having a viscosity of at least 50 SUS at 210°F. The upper viscosity limit for these viscous oil fractions would be 720 SUS at 210°F.

Sulfonating agents which are known to the art can be utilized in the sulfonation step preparing these petroleum sulfonic acids. Sulfonating agents which can be so used include fuming sulfuric acid and liquid sulfur trioxide. Said fuming sulfuric acid can vary from 10 weight percent to 40 weight percent excess sulfuric trioxide. However, when sulfuric acid is used, it is usually preferred to use commercial fuming sulfuric acid which contains about 20 weight percent sulfur trioxide. Liquid sulfur trioxide, i.e., liquid sulfur trioxide in liquid sulfur dioxide, is the presently preferred sulfonating agent for use in preparing the petroleum sulfonic acids used in the practice of this invention. Such liquid sulfur trioxide is commercially available.

When 20 percent fuming sulfuric acid is used as the sulfonating agent, the acid-oil ratio can be in the range of from about 0.1:1 to about 0.7:1, or even 1:1 to produce the petroleum sulfonic acids used in the practice of the invention. A preferred range of acid-oil ratios is in the range of about 0.3 to about 0.6:1. When a mixture of liquid sulfur and liquid sulfur dioxide is the sulfonation agent, the sulfur trioxide to oil weight ratios are maintained equivalent to those available from the 20 percent fuming sulfuric acid values given above. In other words, the sulfur trioxide to oil ratio can be in the range of about 0.02 to 0.2, preferably from about 0.06 to about 0.12:1. The sulfur trioxide to oil ratios can be controlled by varying the rate of flow of the oil or the sulfur trioxide containing medium, or both. The above given ratios are weight ratios.

Sulfonation temperatures can be controlled within the range of about 50° to about 200°F with the preferred operating range between about 80 and about 150°F. At temperatures above about 200°F, excessive oxidation with liberation of sulfur dioxide may take place. A reaction time of about 20 to about 90 minutes is preferred when fuming sulfuric acid is utilized as the sulfonating agent in order to provide optimum yield and quality of products. When sulfur trioxide, e.g., sulfur trioxide and sulfur dioxide, is utilized as the sulfonation agent, the reaction rate is greatly accelerated and the reaction has been found to be substantially completed in the time required to accomplish suitable contact of the oil with the sulfur trioxide, usually less that about 5 minutes. The sulfonation reaction can be carried out at atmospheric pressure although pressures greater or less than atmospheric can be employed, if desired. When using liquid sulfur trioxide in liquid sulfur dioxide as the sulfonating agent, it is preferred to carry out the reaction at sufficient pressure to maintain the sulfur dioxide in liquid phase.

A wide variety of polyamines can be used in the practice of this invention. One class of suitable polyamines can be represented by the formula $$H_2N[CH_2)_xNH]_yH$$

wherein $x$ equals 2–6 and $y$ equals 1–100. Examples from this class of suitable polyamines which can be used in the practice of the invention include, among others, the following:

ethylenediamine,
diethylenetriamine,
triethylenetetramine,
tetraethylenepentamine,
dipropylenetriamine,
butylenediamine,
hexamethylenediamine,
tetrahexylenepentamine,
heptabutyleneoctamine,
and the like.

A second class of suitable polyamines comprises the polymers of 1,2-alkylene imines. Polyalkylene imines can be derived from the acid (e.g., small amount of HCl) catalyzed polymerization of 1,2-alkylene imines of the formula

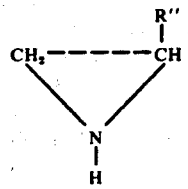

and are polyamines of the general formula $(C_2H_4R'\lambda'N)_n$ wherein n represents the average degree of polymerization and R'' is selected from hydrogen and alkyl radicals having one to 14 carbon atoms such as methyl, ethyl, butyl, tetradecyl, and the like. Polymerized 1,2-alkylene imines of essentially any degree of polymerization (n value) may be used.

Because of its commercial availability over a wide range of molecular weights, a presently preferred polyalkylene imine is polyethylenimine (R''=H). Polyethylenimine, obtained by the acid catalyzed polymerization of ethylene imine, contains a random distribution of primary amino groups of the formula $—CH_2CH_2NH_2$, secondary amino groups of the formula $—CH_2CH_2N—$ and tertiary amino groups of the formula $—CH_2CH_2N—$, in the approximate ratio of one primary amino group: two secondary amino groups: one tertiary amino group. One specific polyethylenimine that can be employed in this invention has an average molecular weight of about 1,800 and an average degree of polymerization of about 42. A commercially available polyethylenimine corresponding to a molecular weight of about 1,800 is PEI 18, available from the Dow Chemical Company of Midland, Michigan. PEI 18, as obtained commercially, is substantially anhydrous.

It is within the scope of this invention to use a mixture of polyamines wherein the mixture includes more than one member from the same class or members from each class.

Other methods of preparing the polyalkylene imines useful in this invention include the reaction of alkylene dichlorides with ammonia and the thermal decarboxylation of 2-oxazolidones.

The amount of petroleum sulfonic acid employed in this invention should be sufficient to neutralize not less than about 10 percent of the total equivalents of primary and secondary amine present in the amount of polyamine employed and should not exceed an amount sufficient to neutralize about 75 percent of the total equivalents of primary and secondary amine, with the further proviso that not less than one equivalent of petroleum sulfonic acid per mole of polyamine should be employed in every case. This can be expressed as a range from 1 equivalent per mole to 0.75 A, wherein A represents the total equivalents of primary and secondary amines present in the amount of polyamine employed. Best results are obtained over a range from 0.15 A to 0.65A.

Generally speaking, sufficient petroleum sulfonic acid is used with the polyamine to obtain a hydrocarbon soluble reaction product. However, it is within the scope of the invention to employ operable ratios of petroleum sulfonic acid to polyamine outside said ranges.

The reaction of the polyamine and the petroleum sulfonic acid to produce the amine petroleum sulfonate can be carried out at any temperature in which the reaction(s) involved will proceed. Generally speaking, said reaction is preferably carried out at temperatures within the range of from about room temperature to 300°F. However, it is presently referred to employ temperatures in the range of 100°F to 225°F, although it is within the scope of the invention to employ operable temperatures outside said ranges.

It is believed that the reaction between the petroleum sulfonic acid and the polyamine is essentially instantaneous, i.e., the reaction takes place as fast as mixing, therefore stirring or other means of agitating the mixture should be maintained without additional process steps for a period of time to insure that mixing and hence the reaction is complete. Generally, at least 5 minutes are allowed to elapse to insure complete mixing. The reaction can be conducted at any pressure, such as atmospheric pressure, suitable for carrying out the reactions involved.

In the preparation of the ashless detergent or additive of this invention, a two-stage process is employed. In the first stage, the petroleum sulfonic acid and the polyamine are introduced into a reaction zone. The two reactants can be introduced simultaneously or in whatever sequence desired. When sufficient time has elapsed to insure substantial completion of this reaction, i.e., the neutralization of the petroleum sulfonic acid, as a second stage a boron compound is introduced to the reaction zone to form a borated product additive of the invention.

The boron compounds useful as the reactant in the above process for preparing the product of the invention include boron oxide, boron oxide hydrate, boron trifluoride, boron tribromide, boron trichloride, boron acids such as boronic acid, boric acid, tetraboric acid, metaboric acid, ammonium salts of boron acid, esters of boron acid, and the like including mixtures of the above compounds. Boric acid is the presently preferred boron compound.

The reaction product from the petroleum sulfonic acid and polyamine which is an amine petroleum sulfonate is allowed to react with a boron compound under conditions and in ratios of reactants such that the levels of boron concentration in the final composition does not exceed about 1.5 percent by weight. A minimum amount of 0.75 weight percent boron in the product additive is at least required and best results are obtained with a boron content of about 1 to 1.4 percent by weight.

The reaction of the boron compound and the amine petroleum sulfonate can be carried out at any temperature and for a period of time sufficient that the reaction(s) involved will proceed. Generally speaking, the reaction is carried out at a temperature within the range of from about 80°F to about 325°F for a period of time of about ½ hour to 25 hours.

The two stages of the process can be conducted in the presence or absence of a diluent as desired. If a diluent is employed, it can be added alone or as a solvent for one or more of the reactants. To be suitable, a diluent need only be inert under the reaction conditions used. Preferred diluents include hydrocarbon liquids having from 5 to 12 carbon atoms per molecule including alkenes, cycloalkenes, aromatics, and alkyl aromatics or mixtures thereof. Also suitable as diluents for this reaction are lube oil stocks having 100°F viscosities up to 150 SUS. A preferred lube oil stock has a 100°F viscosity of about 100 SUS. The lube oil stocks are preferred in those circumstances when it is desirable to recover the additive in an oil base. In this form it can be conveniently used for blending purposes with a lubricant into which it will ultimately be incorporated.

If the currently preferred reaction conditions are employed, no further isolation or purification steps except filtration to remove solids are necessary in order to use the product in gasoline or lubricating oil formulations. It is currently preferred to employ the crude filtered reaction mixture for such purposes as described above without subsequent treatment. In some cases, however, it may be desirable to isolate and purify the product. Such may be accomplished by any methods currently known in the art, such as fractional crystallization, solvent extraction, etc.

The compositions of this invention, when used as a gasoline additive, are added directly to gasoline in either a purified state or as a crude reaction mixture as hereinbefore described. The quantity of additive utilized is in the range of 0.001 to 0.2, preferably 0.01 to 0.1, parts by weight additive per 100 parts by weight gasoline. When gasoline containing this additive is utilized in conventional internal combustion engines, the buildup of hard refractory deposits on intake valves is substantially diminished. In addition, the additive in gasoline is effective as an upper cylinder lubricant, a carburetor cleaner, a solvent for valve deposits, and a fuel line cleaner.

The gasolines into which the invention additives are dispersed are conventional motor fuel distillates boiling in the range of 70°–420°F. Gasolines or automotive fuels to which the described additives perform the functions described include substantially all grades of gasoline presently being employed in automotive and internal combustion aircraft engines. Generally, automotive and aircraft gasolines contain both straight-run and cracked stock with or without alkylated hydrocarbons, reformed hydrocarbons, and the like. Such gasolines can be prepared from saturated hydrocarbons, e.g., straight-run stocks, alkylation products, and the like, with or without gum inhibitors and with or without soluble lead compounds as, for example, tetraethyl lead (T.E.L.) or ethyl fluid. The gasolines may contain as much as about 5 ml of T.E.L. per gallon, such amounts being used commercially in aviation gasolines. These can be leaded or non-leaded and can contain other conventional fuel additives such as antioxidants and the like.

The compositions of this invention are oil-soluble and can be incorporated in lubricating oil formulations in combinations depending on specific service requirements. For example, in many general duty crankcase oil applications, the additives of the invention can be blended with appropriate base oils and other additives to provide high quality lubricating oils which meet the requirements and specifications for their intended use.

Generally speaking, the compositions of this invention can be added to the base lubricating oil in any amount sufficient to produce the desired degree of improvement. For example, the additives can be used in amounts ranging from 0.2 to 30 weight percent of the finished oil. A presently preferred concentration of petroleum sulfonic acid addition product is in the range of about 1 to 15 weight percent of finished oil.

The lubricating oils to which the invention compositions can be added include any suitable mineral oils of lubricating viscosity, such as those used for compounding lubricating oils of SAE 10 to SAE 50 viscosity. These oils can be derived from suitable naphthenic, paraffinic, and mixed base crudes. The lube oils can also contain other additives such as thickeners and the like.

EXAMPLE I

Preparation of Petroleum Sulfonic Acid

A petroleum sulfonic acid was prepared from a solvent-refined, dewaxed lubricating oil fraction derived from Mid-Continent petroleum and having the following properties: viscosity of about 4200 SUS at 100°F and about 210 SUS at 210°F, and viscosity index of about 97. This oil, identified as finished 250 stock, was sulfonated with a 10 percent $SO_3$ — 90 percent $SO_2$ mixture in a continuous operation substantially like that described in said Whitney et al patent. The $SO_3$ to oil weight ratio was about 0.08 and the temperature of the reaction was controlled at about 115°F. The total reaction time was about 5 minutes, including mixing and soaking periods. The system was maintained in liquid phase at a pressure of 100 – 120 psig. Effluent from the sulfonation unit was subjected to a two-stage flash for $SO_3$–$SO_2$ removal.

EXAMPLE II

Preparation of the Amine Sulfonate 709 g Of a solution of the sulfonic acid oil of Example I in SAE 10 lubricating oil base stock (58.86 weight percent acid oil) was reacted with 32 g tetraethylenepentamine (TEPA) in 120 g SAE 10 oil stock by heating the mixture at 218°F (103°C) for 1 hour. The material as produced was used for the preparation of the final product in Example III. The product analyzed 1.5 weight percent nitrogen.

EXAMPLE III

Preparation of the Borated Amine Petroleum Sulfonate 100 g Of the product of Example II was heated to 210°F (99°C) and a slurry of 11.7 g boric acid in 25 g of SAE 10 lubricating oil and 5 ml water was added. The mixture was heated to 280°F (138°C) for 1 hour and the mixture was filtered hot to recover the boron containing product as filtrate. It contained 1.0 weight percent boron.

EXAMPLE IV

Test of Borated Product in Lubrication Formulation

A sample of lubricating oil was prepared having the following composition:

59.92 wt % SAE 10 base lubricating stock
22.7 wt % SAE 20 base lubricating stock
7.0 wt % Commercial calcium petroleum sulfonate
1.08 wt % Lubrizol 1395 (zinc dialkyldithiophosphate)
1.6 wt % Hydrogenated butadiene-styrene copolymer VI improver (Phillips Phil-Aid VII)
0.2 wt % Acryloid 152 (Rohm & Haas) polymethacrylate
5–7.5 wt % Test additive (variable)

The test was a Sequence V-B (Ford Motor Co. V-8 Engine) simulating severe city stop and go driving which is used to evaluate sludge and varnish deposits with various motor oils. The results are tabulated in Table 1.

Table 1

| | Additive Boron Content Wt % | Additive Wt % in Oil | Overall Sludge[1] | Overall Varnish[1] | Piston Varnish[2] |
|---|---|---|---|---|---|
| 1 | 0% Boron (Control)[4] | 5.0 | 39.4 | 27.8 | 7.5 |
| 2 | 1% Boron[5] | 7.5 | 43.0 | 41.1 | 9.0 |
| 3 | Lubrizol 934[3] | 6.0 | 46.2 | 35.3 | 8.0 |
| | SE standard | | 42.5 min. | 40.0 min. | 8.0 min. |

| | Oil ring plugging % | Oil screen plugging % |
|---|---|---|
| 1 | 1 | 1 |
| 2 | 0 | 0 |
| 3 | 0 | 0 |
| (std) | 5% max. | 5% max. |

[1] 50 = clean
[2] 10 = clean
[3] A commercial dispersant additive for motor oil
[4] Amine sulfonate from Example II.
[5] Borated amine sulfonate from Example III.

The test showed that the borated reaction product at 1% by weight boron passes the test specifications set by SAE. The other materials tested, including a commercial additive, fail at least one of the criteria.

EXAMPLE V

In this experiment, a series of borated samples were made having different levels of boron. The sequence of addition was reversed from that of Example III and the amine petroleum sulfonate was added to a boric acid slurry.

A 3-neck, 5 liter flask equipped with an ice-cooled water condenser, stirring means and addition funnel was charged with a slurry of 89.4 g boric acid in 625 ml of toluene. A Dean-Stark receiver was attached to collect the evolved water. The slurry was stirred continuously while being heated to reflux temperature. A mixture of 1018.8 g of product prepared as in Example II in 2500 ml toluene was added through the funnel during a 2-hour period while maintaining the flask at reflux temperature.

Stirring and heating was continued until no more water was being collected in the receiver, a total of about 6 hours. 31 ml water was collected. The mixture was cooled to 29°C and about 60 g Celite filter aid was added. The reaction mixture was vacuum filtered through a Celite coated No. 2 Whatman filter (2 times). The clear mahogany liquid was vacuum distilled at 6 mm Hg to a 149°C end point. 1011.4 g Product was collected.

Samples were prepared to provide concentrations of 1.0, 1.5, and 2.2 weight percent boron for testing as in Example IV. A sample was also prepared by this method from the reaction product of 172 g polyethyleneimine (PEI-18, mol weight 1800) in 509.8 g KC-10 oil. 2180 g of a 58.86 weight percent sulfonic acid oil in KC-10 stock (equivalent to 1284 g acid oil) was added at 54°C and the mixture heated at 100°C for 1 hour. After boric acid treatment according to the above method, a product containing 1.4 weight percent boron was obtained. The results are tabulated below.

Table 2

| Additive Boron Content Wt % | Wt % in Oil | Overall Sludge | Overall Varnish | Piston Varnish | Oil Ring Plugging % | Oil Screen Plugging % |
|---|---|---|---|---|---|---|
| 0% control[4] | 5.0 | 39.4[1] | 27.8[1] | 7.5[2] | 1 | 1 |
| 1%[5] | 7.5 | 34.5 | 25.5 | 6.2 | 6 | 2 |
| 1.5%[5] | 7.5 | 43.5 | 36.5 | 7.8 | 1 | 0 |
| 1.4%[3] | 7.5 | 40 | 33 | 7.6 | 2 | 0 |
| 2.2% | 7.5 | 29 | 26.5 | 6.4 | 24 | 45 |

[1]50 = clean
[2]10 = clean
[3]polyethyleneimine product
[4]Amine sulfonate
[5]Borated amine sulfonate The data show that the second method of preparing the additive does not yield a product quite as good as the one tested in Example IV. It also demonstrates that a boron content of 2.2% has a detrimental effect on the lubricant, especially the plugging values. The 1.4 and 1.5 weight percent boron containing additives made by the second method are best in this sequence but not quite as good as the material of Example I containing only 1% boron.

EXAMPLE VI

The borated material of Example III was compounded in a fuel recipe and tested in a Falcon engine tests.

TABLE 3

Engine Test Procedure to Evaluate Carburetor Detergents

Engine: 170 CID 6 cylinder Falcon
Test Stand: Mid-West Engineering Dynamometer and Toledo Scales
Blow-By Gases: About 0.5 cfm recirculated through standard PCV system
Exhaust Gases: 10% recirculated through top of carburetor
Exhaust Back Pressure: 10–15 inch of $H_2O$
Operating Mode: 23 continuous hours
Operating Condition: 1800 rpm, 11.4 bhp (40 mph road load)
Crankcase Oil: Trop-Artic 10W-30
Oil Changes: After each 200 hours of operation
Oil Temperature: Not controlled, 216° ± 4°F
Coolant Out Temperature: Controlled 196° ± 5°F
Intake Air Temperature: Not controlled, 135° ± 10°F The base fuel was a lead free gasoline, (RON) octane number 94. All additives tested were blended at 10 parts by weight/1000 barrels of fuel. Test results are tabulated below.

Table 4

| Additive | Milligram Deposit: Unwashed | |
|---|---|---|
| 1% by wt boron containing additive | 14.2 | average 13.0 |
| " | 11.8 | |
| Unborated product (Example II) | 23.2 | |
| Amoco 577B[1] | 14.1 | |
| Base fuel | 25.6 | |

[1]A mixture of amides 3.4% weight nitrogen; a commercial detergent fuel additive (Standard Oil of Ind.)

The borated product of Example III displays excellent detergent properties in a fuel composition.

Thus it has been shown that the reaction product of a petroleum sulfonic acid and a polyamine, when treated with a boron compound, with the final level of boron about 1 weight percent can be added to a lubricating oil or automotive fuel with beneficial effects on the overall cleanliness of the motor parts.

I claim:

1. As a new composition, an oil-soluble boron-containing composition having a boron concentration in the range of 0.75 to 1.5 percent by weight which is the reaction product obtained upon reacting a. a petroleum sulfonic acid, b. a polyamine selected from the group consisting of 1. amines of the formula $H_2N[(CH_2)_xNH]_yH$ wherein $x$ equals 2–6 and $y$ equals 1–100, and 2. polymers of alkylene imines of the formula

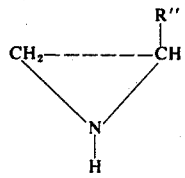

wherein R'' is selected from hydrogen and alkyl radicals having 1–14 carbon atoms, and c. a boron compound.

2. A composition according to claim 1 wherein the boron content is about 1 to 1.4 percent by weight and (*a*) is a petroleum sulfonic acid prepared by sulfonating a petroleum hydrocarbon fraction having a viscosity within the range of 90 to 270 SUS at 210°F and a viscosity index of at least about 85 and (*b*) is tetraethylene pentamine or a polyethylene imine.

3. A composition according to claim 1 wherein the amount of (*a*) present with respect to (*b*) ranges from 1 equivalent per mole to 0.75 A, wherein A represents the total equivalents of primary and secondary amines present in the amount of polyamine employed.

4. A composition according to claim 1 wherein said reaction product is formed by reacting (*a*), (*b*) and (*c*) at a temperature in the range of room temperature to 325°F.

5. A lubricating oil composition comprising a major proportion of a lubricating oil containing a small but effective amount, sufficient to impart detergency to said lubricating oil, of an oil-soluble dispersant additive which is the reaction product defined according to claim 1.

6. A composition according to claim 5 wherein the lubricating oil composition contains from about 0.2 to about 30 weight percent of said oil-soluble dispersant additive.

7. A composition comprising a major proportion of a lubricating oil and from about 0.2 to about 30 weight percent of the reaction product of claim 2.

8. An internal combustion engine fuel comprising hydrocarbons in the gasoline boiling range containing a small but effective amount, sufficient to impart increased detergency to said fuel, of an oil-soluble dispersant additive which is the reaction product defined according to claim 1.

9. A composition according to claim 8 wherein the amount of said additive present in said motor fuel is in the range of 0.001 to 0.2 parts by weight additive per 100 parts by weight of gasoline.

10. A composition according to claim 8 which contains up to 5 ml tetraethyl lead per gallon.

11. An internal combustion engine fuel comprising a major proportion of hydrocarbons in the gasoline boiling range of 70°–420°F and about 0.001 to 0.2 weight parts of the reaction product of claim 2 per 100 weight parts of gasoline.

12. A process for the preparation of a lubricating oil and gasoline additive which comprises a. contacting a petroleum sulfonic acid with at least one polyamine selected from the group consisting of 1. amines of the formula $H_2N[(CH_2)_xNH]_yH$ wherein $x$ equals 2–6 and $y$ equals 1–100, and 2. polymers of alkylene imines of the formula

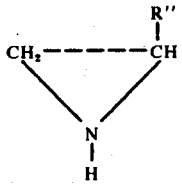

wherein R'' is selected from hydrogen and alkyl radicals having 1–14 carbon atoms, and under conditions which produce an amine petroleum sulfonate, wherein the equivalents of petroleum sulfonic acid to polyamine is in the range of 1 equivalent per mole to 0.75 A, wherein A represents the total equivalents of primary and secondary amines present in the amount of polyamine employed and b. interreacting the amine petroleum sulfonate obtained in step (*a*) with a boron compound under conditions which produce a borated amine petroleum sulfonate having from 0.75 to 1.5 weight percent boron.

13. A process according to claim 12 wherein said contacting and said interreacting are carried out in the presence of an inert diluent which is a lubricating oil base stock and said contacting is carried out at a temperature in the range of room temperature to 300°F for a period of time sufficient to form an amine petroleum sulfonate and said interreacting is carried out at a temperature in the range of 80° to 300°F for a period of time sufficient to form said borated product additive.

14. A process according to claim 12 wherein the boron compound and a diluent which is a lubricating oil base stock are slowly added to the amine petroleum sulfonate obtained in step (*a*).

* * * * *